US009777363B2

(12) United States Patent
Abraha

(10) Patent No.: US 9,777,363 B2
(45) Date of Patent: Oct. 3, 2017

(54) SURFACE LAYER HARDENED METAL MATERIAL AND SURFACE LAYER HARDENING METHOD

(71) Applicant: MEIJO UNIVERSITY, Aichi (JP)

(72) Inventor: Petros Abraha, Aichi (JP)

(73) Assignee: MEIJO UNIVERSITY, Aichi (JP)

( * ) Notice: Subject to any disclaimer, the term of this patent is extended or adjusted under 35 U.S.C. 154(b) by 52 days.

(21) Appl. No.: 14/653,573

(22) PCT Filed: Dec. 25, 2013

(86) PCT No.: PCT/JP2013/084642
§ 371 (c)(1),
(2) Date: Jun. 18, 2015

(87) PCT Pub. No.: WO2014/104085
PCT Pub. Date: Jul. 3, 2014

(65) Prior Publication Data

US 2015/0368780 A1 Dec. 24, 2015

(30) Foreign Application Priority Data

Dec. 26, 2012 (JP) ..... 2012-283532
Oct. 1, 2013 (JP) ..... 2013-206380

(51) Int. Cl.

| | |
|---|---|
| ***C23C 8/24*** | (2006.01) |
| ***C23C 8/02*** | (2006.01) |
| ***C21D 1/06*** | (2006.01) |
| ***C21D 1/09*** | (2006.01) |

(52) U.S. Cl.
CPC ..... *C23C 8/02* (2013.01); *C21D 1/06* (2013.01); *C21D 1/09* (2013.01); *C23C 8/24* (2013.01); *Y10T 428/24983* (2015.01)

(58) Field of Classification Search
CPC ..... C23C 8/24; C23C 8/26
See application file for complete search history.

(56) References Cited

FOREIGN PATENT DOCUMENTS

| | | | |
|---|---|---|---|
| JP | 06184727 | A | 7/1994 |
| JP | 08104973 | A | 4/1996 |
| JP | 09078224 | A | 3/1997 |
| JP | 2002356764 | A | 12/2002 |
| JP | 2006131922 | A | 5/2006 |
| JP | 2006231386 | A | 9/2006 |

(Continued)

OTHER PUBLICATIONS

Farokhzadeh, K., J. Qian, and A. Edrisy. "Effect of SPD surface layer on plasma nitriding of Ti—6Al—4V alloy." Materials Science and Engineering: A589 (2014): 199-208.*

(Continued)

*Primary Examiner* — Jessee Roe
(74) *Attorney, Agent, or Firm* — Smith, Gambrell & Russell, LLP

(57) ABSTRACT

Providing improved wear resistance to a metal material by hardening a surface layer and a surface layer hardening method. A base material is nitrided so that a metal material (40) has a surface layer hardened. The surface layer of the base material is formed with no nitrogen compound layer (40C), and the base material includes a region from a surface thereof to a depth of 78 μm, the region having a Vickers hardness higher than the base material by not less than 5%.

2 Claims, 9 Drawing Sheets

(56) References Cited

FOREIGN PATENT DOCUMENTS

| | | | |
|---|---|---|---|
| JP | 2010058164 | A | 3/2010 |
| JP | 2011052313 | A | 3/2011 |

OTHER PUBLICATIONS steelmanager.eu/files/en10025.pdf (Jan. 2006).*
International Search Report for PCT/JP2013/084642 dated Apr. 8, 2014 in English and Japanese language.

* cited by examiner (a) Treatment time : 3 hrs (b) Treatment time : 6 hrs (c) Treatment time : 12 hrs (a) Treatment time : 1.5 hrs (b) Treatment time : 3 hrs (c) Treatment time : 6 hrs

SURFACE LAYER HARDENED METAL MATERIAL AND SURFACE LAYER HARDENING METHOD

TECHNICAL FIELD

The present invention relates to a surface layer hardened metal material and a surface layer hardening method.

BACKGROUND ART

A technique that forms a nitrogen diffusion layer in a surface layer of a metal material to harden the surface layer is generally known. The technique is referred to as a nitriding treatment. A plasma nitriding treatment using nitrogen plasma is a nitriding treatment capable of forming a nitrogen diffusion layer in a surface layer of a metal material at a lower temperature. However, since nitrogen ions in the nitrogen plasma are excessively supplied to the surface of the metal material in a conventional plasma nitriding treatment (referred to as an ion nitriding treatment), an undesirable brittle nitrogen compound layer is formed in the surface layer of the metal material on top of a nitrogen diffusion layer formed in the surface layer of the metal material (see undermentioned Patent Document 1).

A neutral nitriding treatment has been devised as a plasma nitriding treatment that suppresses the formation of the nitrogen compound layer. In neutral nitriding treatment, the metal material is protected so that nitrogen ions in the nitrogen plasma is prevented from entering the metal material and only nitrogen atoms contribute to the formation of the nitrogen diffusion layer (see undermentioned Patent Document 2).

PRIOR ART DOCUMENT

Patent Documents

Patent Document 1: Japanese Patent Application Publication No. JP-A-2002-356764

Patent Document 2: Japanese Patent Application Publication No. JP-A-2011-052313

SUMMARY OF THE INVENTION

Problem to be Overcome by the Invention

However, it is necessary to increase the speed of the nitrogen diffusion to the surface layer of the metal material and to form a deeper nitrogen diffusion layer.

The present invention was made in view of the above-described conventional circumstances and the objective thereof is to provide a surface layer hardened metal material and a surface layer hardening method by forming a deeper nitrogen diffusion layer without forming the nitrogen compound layer in the surface layer of the metal material.

Means for Overcoming the Problem

The first invention provides a surface layer hardened metal material having a surface layer hardened by nitriding a base material, wherein the surface layer of the base material is formed with no nitrogen compound layer, and the base material includes a region extending from a surface thereof to a depth of 78 μm, the region having a Vickers hardness higher than the base material by not less than 5%.

The metal material has the surface layer formed with no nitrogen compound layer and includes the region extending from the surface thereof to the depth of 78 μm and having the Vickers hardness higher than the base material by not less than 5%. Consequently, a hardened metal material having a high wear resistance can be obtained without the removal of the nitrogen compound layer by grinding and the like after nitriding.

The second invention provides a surface layer hardening method including a pretreatment step by a shot blast treatment that causes elastic bodies to collide against a surface of a metal material and a nitriding step of placing the metal material pretreated through the pretreatment step, within a treatment chamber, and forming a nitrogen diffusion layer in a surface layer of the pretreated metal material by nitrogen plasma generated by irradiating a nitrogen gas introduced into the treatment chamber with electron beams.

In this surface layer hardening method, after the pretreatment step by the shot blast treatment that causes elastic bodies to collide against a surface of a metal material, the nitriding step is carried out forming the nitrogen diffusion layer in the surface layer of the pretreated metal material, whereby the nitrogen diffusion layer is formed deeper with the result that the surface layer of the metal material can be hardened.

MODE FOR CARRYING OUT THE INVENTION

Embodiments of the first invention and the second invention will be described.

In the metal material of the first invention, the surface layer may have a hardness change continuously transitioning. In this case, fracture due to stress concentration, fatigue or the like is less likely to occur in the hardened surface.

In the surface layer hardening method of the second invention, in the nitriding step, nitrogen ions of the nitrogen plasma are blocked from entering the surface of the pretreated metal material and only nitrogen atoms are allowed to enter the surface of the pretreated metal material, so that the nitrogen diffusion layer is formed in the surface layer. In this case, the nitrogen ions can be blocked from entering the surface of the pretreated metal material. This can suppress the precipitation of the nitrogen compound layer to the surface layer due to excessive supply of nitrogen ions.

In the surface layer hardening method of the second invention, in the nitriding step, a shielding grid is provided to surround the pretreated metal material and the nitrogen ions are blocked by the shielding member from entering the surface of the pretreated metal material. In this case, the nitrogen ions can easily be blocked from entering the surface of the pretreated metal material using the shielding member.

With reference to the drawings, an embodiment will be described which embodies the surface layer hardened metal material of the first invention and the surface layer hardening method of the second invention.

<Embodiment>

A metal or a tool steel SKD 61 used to make tools is used as a sample (a metal material) 40 having a surface layer to be hardened. The sample 40 is formed into a disc shape and has a diameter of 20 mm and a thickness of 2 mm.

The surface layer hardening method includes two steps; a pretreatment step of applying a shot blast treatment in which shot materials that deform elastically upon collision (elastic bodies) 2 are accelerated to cause collision against the surface of the sample 40 and a nitriding step of forming a nitrogen diffusion layer 40D in a surface layer of the pretreated sample 40 by a plasma nitriding apparatus 9 with the use of nitride plasma.

Figure 1:
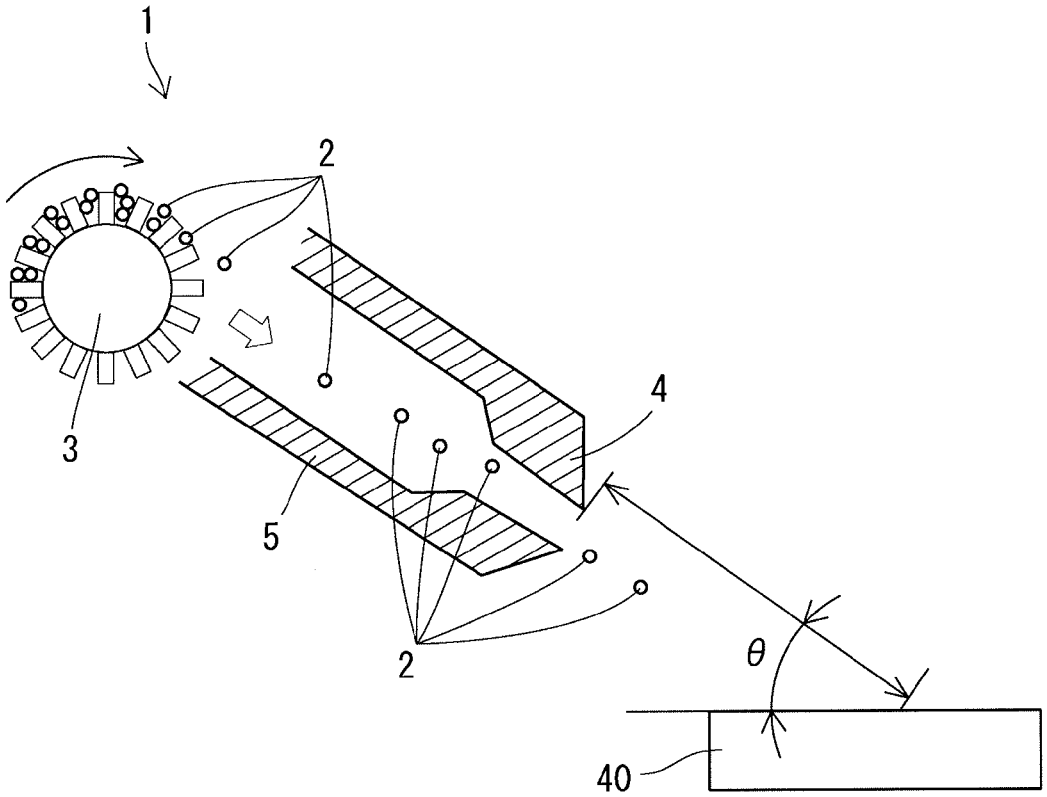
FIG. 1 is a schematic diagram of shot blast treatment.

FIG. 1 is a schematic diagram of the shot blast treatment in the pretreatment step. A blasting machine 1 is a mechanical shot blasting apparatus SMAP (manufactured by Toyo Kenmazai Kogyo Ltd., Tokyo, Japan). The blasting machine 1 includes a projecting part 3 which projects shot materials 2 while being rotated, a projection nozzle 4 having a nozzle diameter of 5 mm, and a cabinet 5 leading the shot materials 2 to the projection nozzle 4. An angle between the sample 40 and the projection nozzle 4 (a projection angle) is set to 40° and a distance from a distal end of the projection nozzle 4 to the sample 40 is set to 40 mm.

Figure 2:
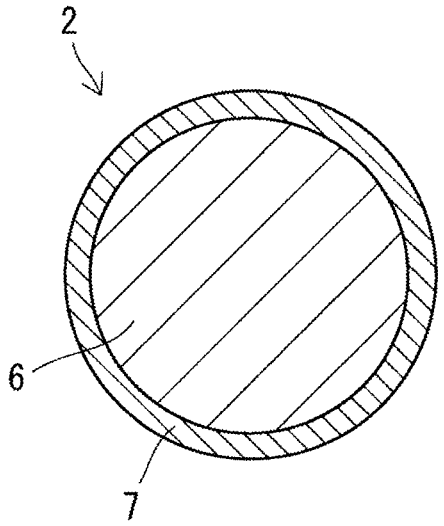
FIG. 2 is a schematic diagram of shot material.

FIG. 2 is a schematic diagram of the shot material 2. The shot material 2 includes a spherical body 6 made of resin and having a diameter of 0.4 mm. The spherical body 6 has an entire circumference covered with diamond abrasive grain 7 having a grain diameter not more than 1 μm. The shot material 2 has elasticity since the inside thereof is made of resin. The shot material 2 has the mass of about 4.55×1E-8 kg.

A procedure of the shot blast treatment will now be described.

The shot materials 2 are accelerated from the projecting part 3 of the blasting machine 1 which rotates at a rotational speed of 1 Hz. The shot materials 2 projected from the projecting part 3 pass through the cabinet 5 to be projected onto the sample 40 from the projection nozzle 4 formed to be narrower than the cabinet 5. The shot materials 2 are accelerated to cause collision against the sample 40 while maintaining the kinetic energy at the time of projection from the projecting part 3. The collision energy in this case is about 7.1×1E-9J. A projecting time of the shot materials 2 is one minute, and an amount of projection of the shot materials 2 is 500 g.

The shot blasting treatment in which the elastic shot materials 2 are accelerated to collide against the surface of the sample 40 has an exceedingly lower collision energy than the conventional shot blast treatment in which metal particle (steel shot) is used. Accordingly, the sample 40 has a lower observed value of surface hardening after the shot blast treatment than the steel shot. More specifically, the sample 40 has a Vickers hardness value of not more than 100 Hv after the shot blast treatment.

Next, the nitriding step will be described.

Figure 3:
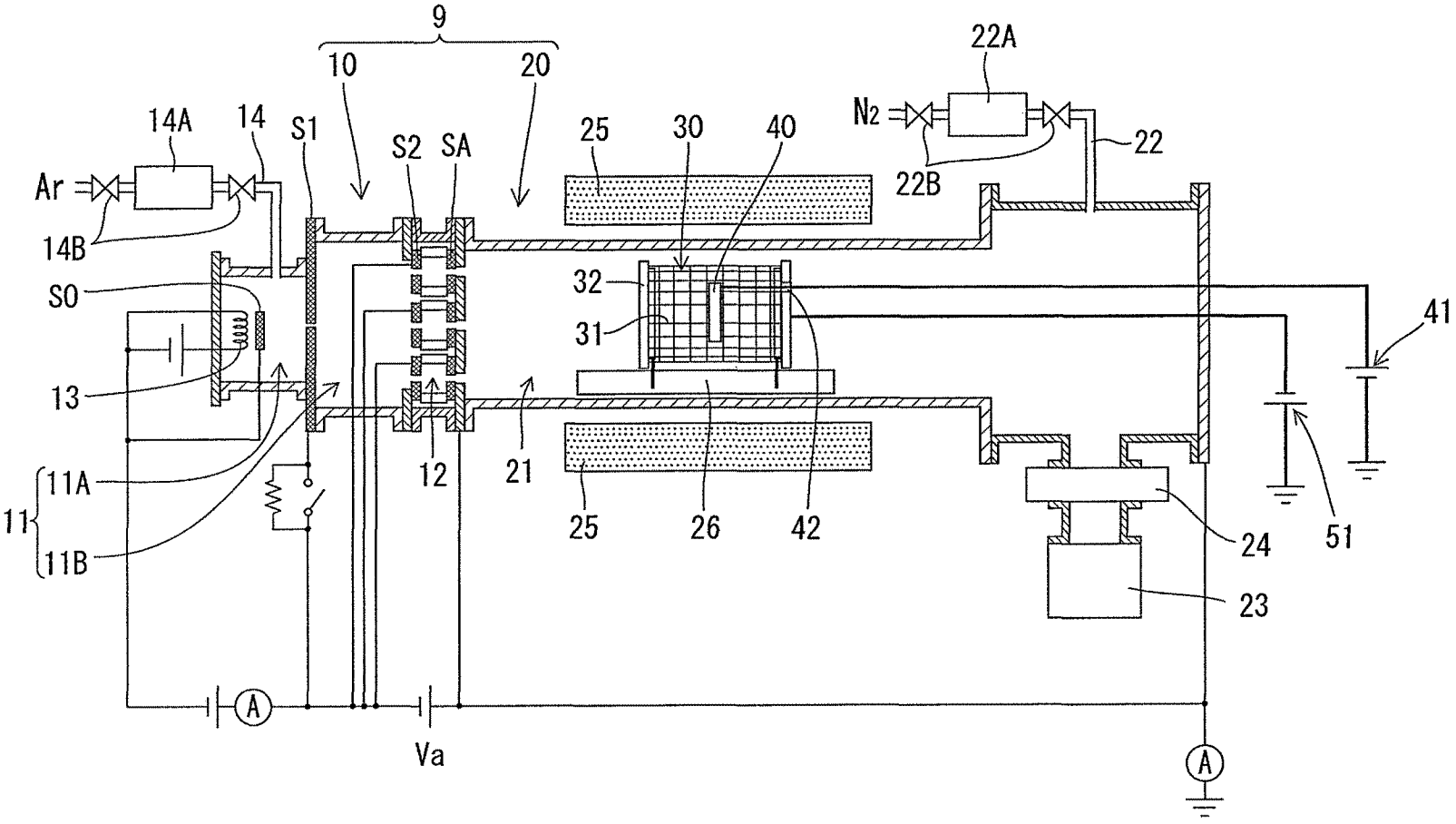
FIG. 3 is an illustration of plasma nitriding apparatus.

A plasma nitriding apparatus 9 used in the nitriding step includes an electron beam gun 10 and a treatment chamber 20, as shown in FIG. 3. The electron beam gun 10 has a discharge region 11 and an acceleration region 12. The discharge region 11 is divided by an intermediate electrode S1 having a centrally located orifice into a first discharge region 11A and a second discharge region 11B. A filament 13 and a cathode S0 are located in the first discharge region 11A. The first discharge region 11A connects with a first gas piping 14 further connecting with an argon gas supply source. A first mass flow controller 14A is disposed across the first gas piping 14. On-off valves 14B are also disposed across the first gas piping 14 so as to be located upstream and downstream of the first mass flow controller 14A respectively.

The second discharge region 11B is separated by a discharge anode S2 from the acceleration region 12. The acceleration region 12 is sandwiched by the discharge anode S2 and an acceleration electrode SA to which an acceleration voltage Va is applied.

The electron beam gun 10 starts discharge when an argon gas is introduced through the first gas piping 14 into the discharge region 11, and DC voltage is applied between the cathode S0 and the intermediate electrode S1. Argon is then ionized with the result that a large number of electrons are generated in the discharge region 11. Only the electrons are accelerated from the plasma space by the acceleration voltage Va between the discharge anode S2 and the acceleration electrode SA, so that electron beams are generated. The generated electron beams are delivered into the treatment chamber 20.

The treatment chamber 20 forms a plasma region 21, which connects with a second gas piping 22 further connecting with a nitrogen gas supply source. A second mass flow controller 22A is disposed across the second gas piping 22. On-off valves 22B are also set across the second gas piping 22 so as to be located upstream and downstream of the second mass flow controller 22A respectively. The plasma region 21 connects with a vacuum pump 23 which decompresses the plasma region 21 via the gate valve 24. The treatment chamber 20 is provided with an electric heater 25 disposed around the middle part thereof.

A nitrogen gas is introduced through the second gas piping 22 into the plasma region 21, and electron beams are delivered from the electron beam gun 10, so that nitrogen molecules are dissociated and ionized with the result that nitrogen plasma is generated in the treatment chamber 20.

Further, the plasma nitriding apparatus 9 is provided with a stage 26 made of quartz and located in the plasma region 21. The plasma nitriding apparatus 9 further includes a metal net-like cage (a shielding member) 30 mounted on the stage 26 and electrically insulated from the treatment chamber 20. The cage 30 includes a metal mesh 31 made of stainless and formed into a cylindrical shape. The cage 30 has two ends to which stainless ring frames 32 are attached respectively. Further, the cage 30 has two ends which are formed by the frames 32 and to which the circular metal mesh 31 is attached. The metal mesh 31 is formed of a wire which has a diameter of 0.16 mm and is netted into a mesh shape having 40 meshes per inch. The pretreated sample 40 can be disposed in the cage 30.

The plasma nitriding apparatus 9 includes a first DC power supply device 41 which is capable of applying to the sample 40 a bias voltage of positive potential higher than the plasma potential at a location where the sample 40 is disposed in the cage 30. The plasma nitriding apparatus 9 also includes a second DC power supply device 51 capable of applying a bias voltage of negative potential to the cage 30. The plasma nitriding apparatus 9 further includes a thermocouple 42 capable of measuring a temperature of the sample 40.

The following sections describe two nitriding methods using the plasma nitriding apparatus 9.

Upon irradiation with electron beams, nitrogen plasma is generated around the sample 40. Further, the second DC power supply device 51 applies the bias voltage of negative potential to the cage 30. As a result, nitrogen ions in the nitrogen plasma are accelerated toward the cage 30. Since the cage 30 is configured of the metal mesh 31, the nitrogen ions reaching the cage 30 pass through the metal mesh. Apart of the nitrogen ions incident on wire rods of the metal mesh 31 receives electrons from the wire rods thereby recombining to nitrogen atoms, which enter the surface of the sample 40 while maintaining acceleration. More specifically, only the nitrogen atoms enter the surface of the sample 40.

The first DC power supply device 41 applies the bias voltage of positive potential higher than the plasma potential to the sample 40. Accordingly, nitrogen ions having entered the cage 30 are rebounded by an electric field of the sample 40 thereby blocked from entering the surface of the sample 40. Thus, only the nitrogen atoms of the nitrogen plasma selectively enter the surface of the sample 40 with the result that a nitrogen diffusion layer 40D is formed in a surface layer of the sample 40. This method is referred to as "neutral nitriding."

On the other hand, in a conventional nitriding method, the first DC power supply device 41 applies the bias voltage of negative potential to the sample 40 without use of the cage 30, so that nitrogen ions positively enter the surface of the sample 40 with the result that the nitrogen diffusion layer 40D is formed in the surface layer of the sample 40. This conventional method is referred to as "ion nitriding."

The following will describe conditions for the nitriding treatment by the plasma nitriding apparatus 9.

A flow rate of argon gas is controlled to 20 sccm using the first mass flow controller 14A. A flow rate of nitrogen gas is also controlled to 40 sccm using a second mass flow controller 22A. Acceleration voltage Va is set to 80 V and beam current of electron beams is set to 8.0 A. The nitrogen pressure in the treatment chamber 20 is set to 0.4 Pa and an electric heater 25 is energized to increase the temperature of the sample 40 to 500° C. The surface of the sample 40 was treated under the foregoing conditions by neutral nitriding or ion nitriding.

After the completion of the pretreatment, neutral nitriding was carried out for three standard treatment times, 3, 6 and 12 hours, producing samples N1, N2 and N3.

Further, a comparative sample was prepared, for which only neutral nitriding treated for 6 hours without the pretreatment was carried out, thus sample N' was prepared. The ion nitriding was carried out for three standard treatment times, 1.5, 3 and 6 hours without the pretreatment, so that samples I1, I2 and I3 were prepared. Cross-section observation by the use of metallograph and depthwise Vickers hardness evaluation were carried out for all samples 40.

The following is a procedure for carrying out the cross-section observation of the sample 40 by the metallograph. Firstly, the treated sample 40 was cut by a diamond cutter and mounted in resin. The section was thereafter ground using alumina with a grain size of 0.05 μm. Subsequently, the sample 40 was immersed in nital with nitric acid concentration of 3% for 30 seconds so that only the nitrogen diffusion layer 40D was etched to become dark colored.

Figure 4:
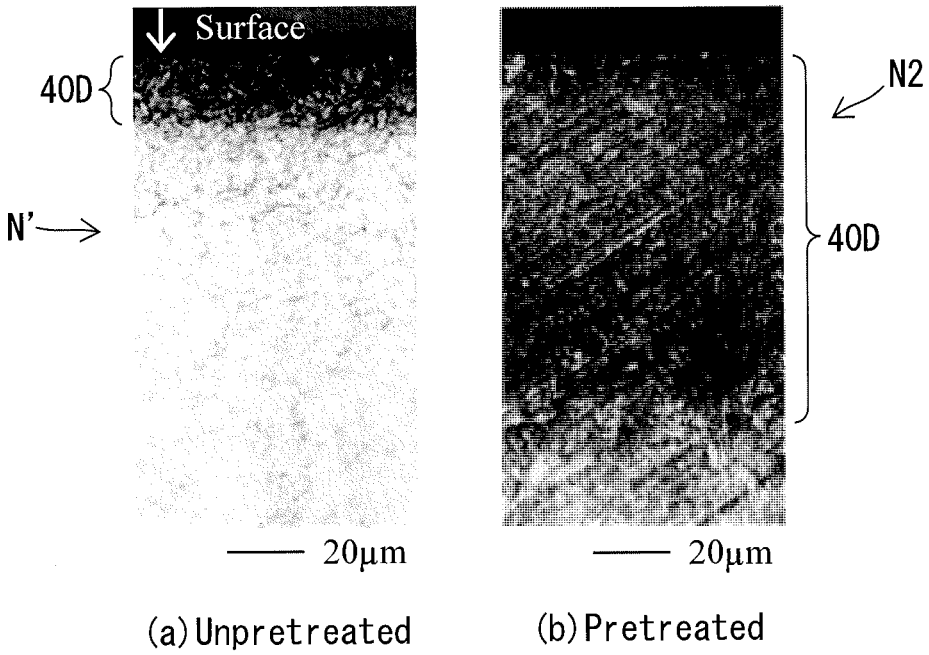
FIGS. 4(*a*) and 4(*b*) are cross-section metallographs of sample N2 and sample N'.

FIG. 4(*a*) shows a cross-section metallograph of sample N' obtained by carrying out neutral nitriding for 6 hours without the pretreatment. FIG. 4(*b*) shows a cross-section metallograph of sample N2 obtained by carrying out neutral nitriding for 6 hours with the pretreatment. The dark colored etched regions in FIGS. 4(*a*) and 4(*b*) correspond to the nitrogen diffusion layers 40D, as described above. It is understood from FIGS. 4(*a*) and 4 (*b*) that the dark colored layer spreads broader and the nitrogen diffusion layer 40D is formed deeper in the sample N2 obtained by carrying out the neutral nitriding with the pretreatment than in the sample N' obtained by carrying out the neutral nitriding without the pretreatment. Accordingly, it is understood that the nitrogen diffusion layer 40D can be formed deeper in the surface of the sample 40 when the plasma nitriding is carried out with the pretreatment than when the plasma nitriding is carried out without the pretreatment.

Figure 5:
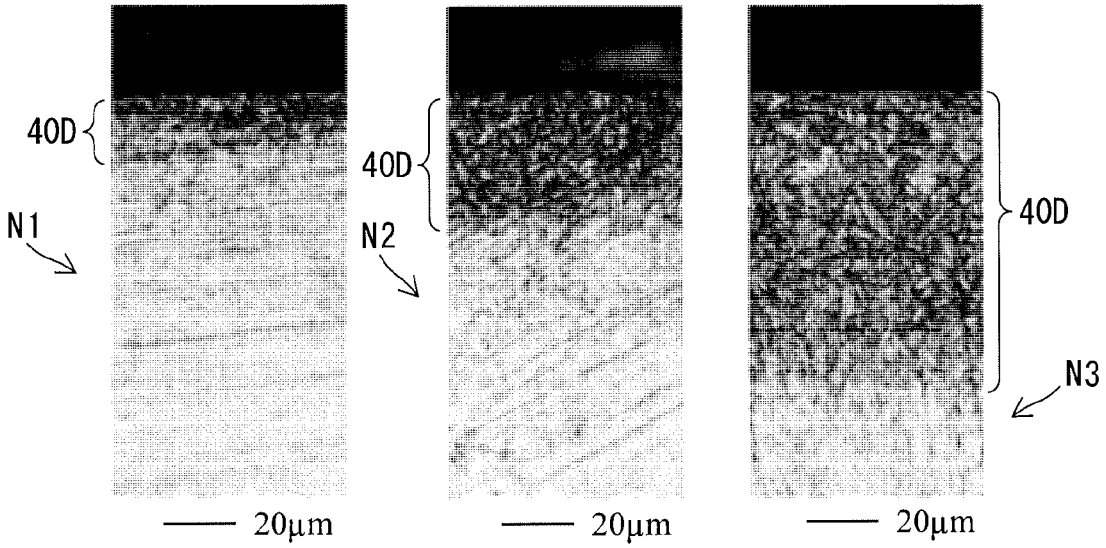
FIGS. 5(*a*), 5(*b*) and 5(*c*) are cross-section metallographs of samples treated by neutral nitriding.
Figure 6:
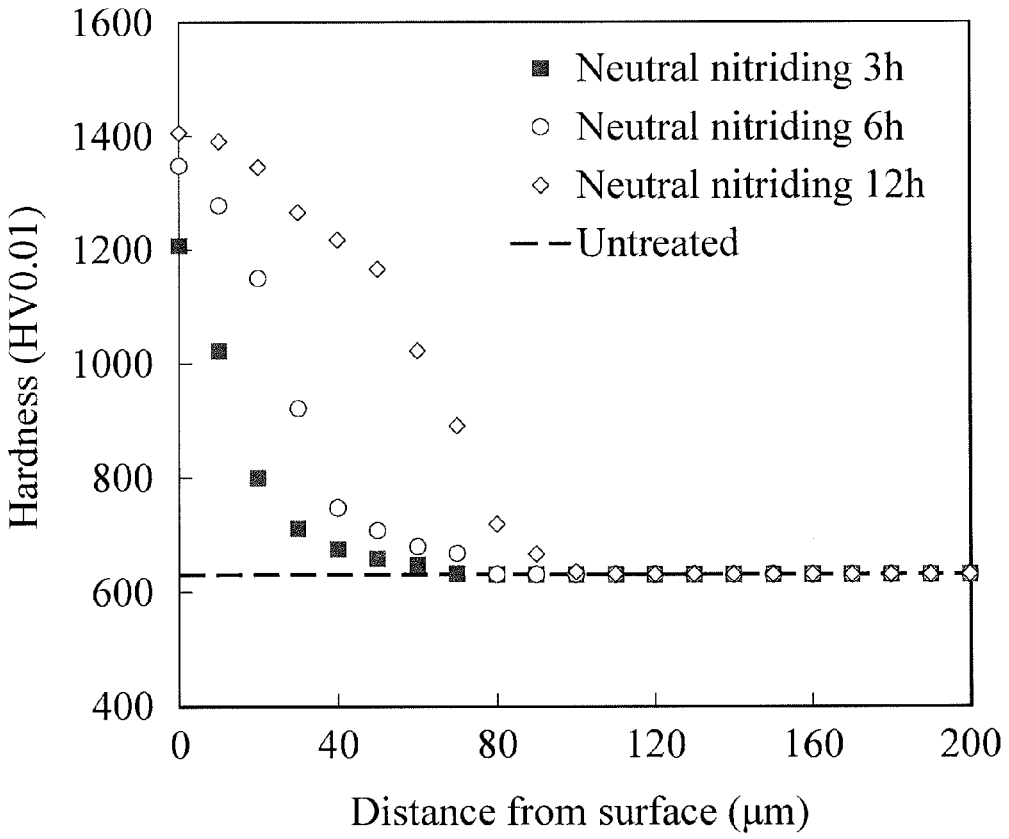
FIG. 6 is a graph showing treatment time dependency of depthwise Vickers hardness profile of samples treated by neutral nitriding.
Figure 7:
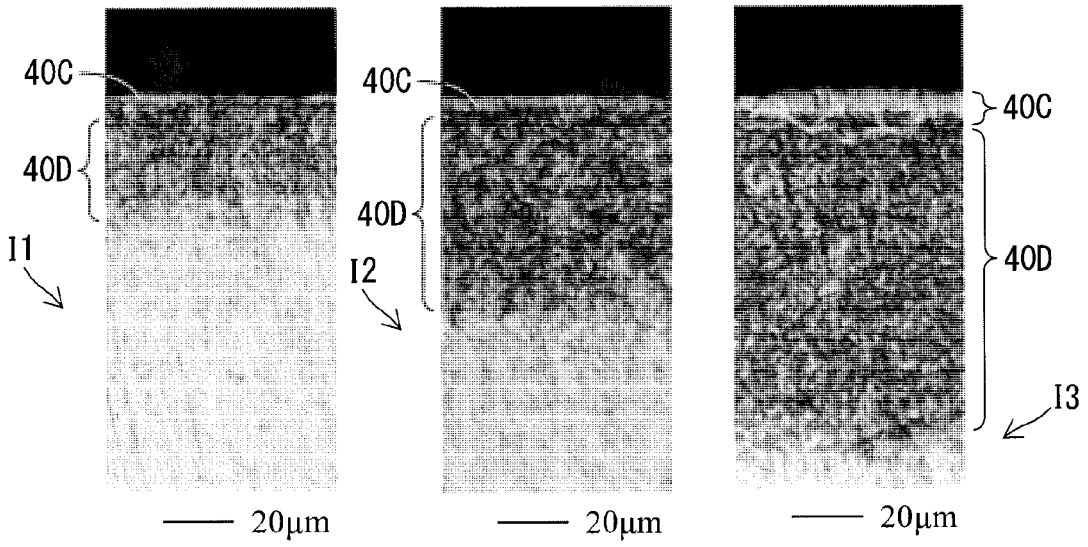
FIGS. 7(*a*), 7(*b*) and 7(*c*) are cross-section metallographs of samples treated by ion nitriding.
Figure 8:
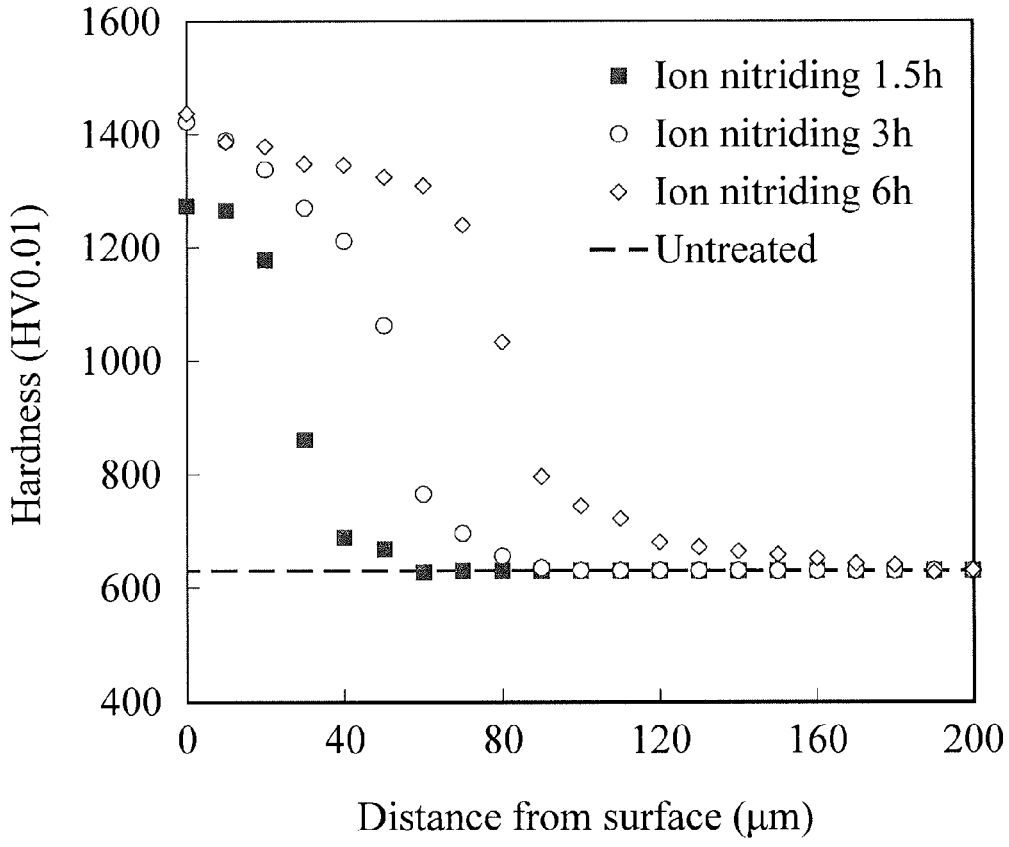
FIG. 8 is a graph showing treatment time dependency of depthwise Vickers hardness profile of samples treated by ion nitriding.

FIGS. 5(*a*), 5(*b*) and 5(*c*) show cross-section metallographs of samples N1 to N3 obtained by carrying out the pretreatment and the neutral nitriding for 3, 6 and 12 hours, respectively. Further, FIG. 6 shows the relationship between the treatment time and depthwise Vickers hardness profile of the samples N1 to N3 obtained by carrying out the pretreatment and the neutral nitriding. FIGS. 7(*a*), 7(*b*) and 7(*c*) are cross-section metallographs of samples I1 to I3 obtained by carrying out the ion nitriding for 1.5, 3 and 6 hours, respectively. FIG. 8 shows the relationship between the treatment time and depthwise Vickers hardness profile of the samples I1 to I3 obtained by carrying out the ion nitriding.

The dark colored layer spreads by increasing the treatment time with respect to each one of samples N1 to N3 to each one of which the neutral nitriding is applied and with respect to each one of samples I1 to I3 to each one of which the ion nitriding is applied. It is understood from FIGS. 5(*a*)-5(*c*) and 7(*a*)-7(*c*) that the nitrogen diffusion layer 40D is formed deeper by increasing the treatment time. Further, it is understood from FIGS. 6 and 8 that regarding each one of the samples 40 to which the neutral nitriding or the ion nitriding is applied, the Vickers hardness of the surface layer is increased by increasing the treatment, with the result that surface layer hardening is enhanced.

One of the samples 40, SKD 61, has Vickers hardness of about 630 Hv before the nitriding treatment. The depth at which the Vickers hardness is increased by 5% relative to the sample 40 before the nitriding treatment (about 660 Hv) is defined as "nitrogen diffusion depth." Nitrogen diffusion depths of three samples (samples N1 to N3) to which the neutral nitriding was applied are estimated at about 45 μm, about 67 μm and about 92 μm respectively from FIG. 6. Further, nitrogen diffusion depths of three samples (samples I1 to I3) to which the ion nitriding was applied are estimated at about 48 μm, about 80 μm and about 128 μm respectively from FIG. 8. It is understood that the nitrogen diffusion depth is increased by increasing the treatment time with respect to each one of samples 40 to which either the neutral nitriding or the ion nitriding was applied. It is also understood that each one of samples 40 to which the ion nitriding was applied has a higher rate of formation of the nitrogen diffusion layer 40D and a deeper nitrogen diffusion depth than the samples 40 to which the neutral nitriding treatment was applied.

When focusing attention on FIGS. 7(*a*) to 7(*c*) again, a white nitrogen compound layer 40C is confirmed on the surface of each one of the samples I1 to I3 to which ion nitriding was applied. Further, when focusing attention on FIGS. 5(*a*) to 5(*c*), no nitrogen compound layer 40C is visually confirmed with respect to the samples N1 to N3 to which the neutral nitriding was applied.

Figure 9:
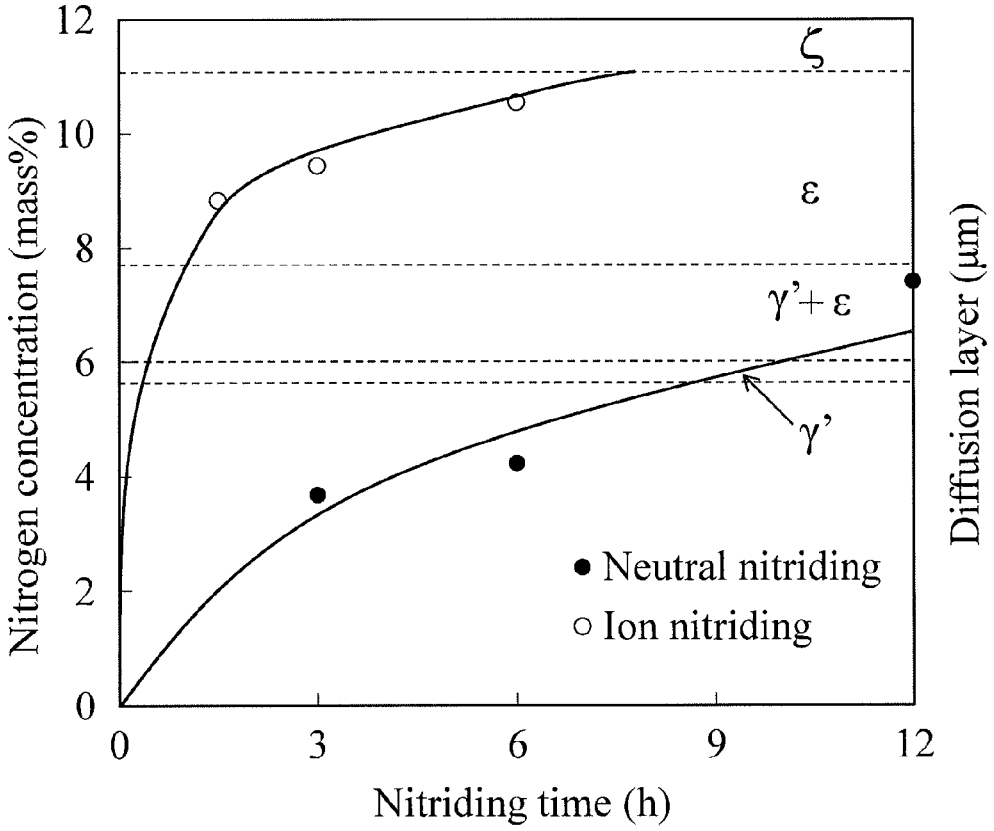
FIG. 9 is a graph showing the relationship between a treatment time, and surface nitrogen concentration and surface precipitated material.

FIG. 9 shows the relationship between a surface nitrogen concentration and a surface precipitated material, and the treatment time. FIG. 9 shows that a nitrogen compound layer E (40C) with elements contained in SKD 61 is precipitated on the surface when the nitrogen concentration in SKD 61 exceeds 6 wt % (a generation threshold). In the case of the ion nitriding treatment, the nitrogen concentration exceeds the generation threshold upon elapse of about several tens of minutes. In the case of the neutral nitriding, the slope of the curve of surface nitrogen concentration relative to the treatment time is more gentle than in the ion nitriding, and the nitrogen diffusion layer 40D is not precipitated on the surface unless the nitriding treatment is done for more than 9 hours.

More specifically, it is impossible in principle to form the nitrogen diffusion layer 40D deep without formation of the nitrogen compound 40C on the surface although the ion nitriding has a higher rate of formation of the nitrogen diffusion layer 40D than the neutral nitriding. Since the nitrogen concentration exceeds the generation threshold regarding sample N3 obtained by performing neutral nitriding for 12 hours, it is assumed that a nitrogen compound layer 40C which is thin such that it cannot be confirmed from the cross-section metallograph of FIG. 5(*c*) is formed on the surface of sample 40.

From the foregoing, in order that the nitrogen diffusion layer 40D may be formed deeper without precipitation of nitrogen compound layer 40C in the surface layer, it is better to carry out the shot blast treatment in which the elastic shot materials 2 are accelerated to cause collision against the surface of the sample 40 and thereafter perform neutral nitriding for 9 hours.

The nitrogen diffusion depth and the treatment time are in a linear relationship. Accordingly, data of samples N1 to N3 obtained by performing of the neutral nitriding are linearly approximated, so that the nitrogen diffusion depth of about 78 μm can be obtained by a 9-hour neutral nitriding.

According to the above-described embodiment, the shot blast treatment in which the elastic shot materials 2 are accelerated to cause collision against the surface of the metal material 40 is carried out and thereafter, the neutral nitriding in which only the nitrogen atoms contribute to the formation of the nitrogen diffusion layer 40D is executed, with the result that the metal material 40 having a high hardness from the surface to the depth of about 78 μm can be manufactured without precipitation of nitrogen compound layer 40C in the surface layer of the metal material 40.

The metal material 40 treated by the above-described nitriding is superior in wear resistance and can improve the service life when processed to be used in manufacturing tools and the like. Further, since no brittle nitrogen compound layer 40C is formed in the surface layer of the metal material 40, the nitrogen compound layer 40C need not be removed by grinding or the like and thus reducing the operating costs.

Further, when the nitrogen compound layer 40C is formed in the surface layer, there is a possibility that a coated TiN (titanium nitride) film may be easily detached in the case where a combined hardening treatment is carried out in which the metal material 40 is further coated with a TiN (titanium nitride) film or the like. On the other hand, the metal material 40 which has been treated by the neutral nitriding is effective in performing combined hardening treatment since no nitrogen compound layer 40C is formed in the surface layer of the metal material 40.

Further, the following will be understood from the comparison of FIGS. 6 and 8. In the neutral nitriding, a hardness change rate from the surface to the depth of about 50 μm is −206/40 [0.01 Hv/μm], that is, −5.1 [0.01 Hv/μm] in a 12-hour treatment, as shown in FIG. 6. On the other hand, in the ion nitriding, a hardness change rate from the surface to the depth of about 70 μm is −80/40 [0.01 Hv/μm], that is, −2 [0.01 Hv/μm] in a 6-hour treatment, as shown in FIG. 8.

Generally speaking, when the nitrogen diffusion layer 40D has a constant depth ranging from about 120 μm to 200 μm from the surface, it is desirable that a hardness change in the inside of the metal material 40 should continuously transition from the surface hardness of about 1400 Hv to the hardness of 630 Hv of the metal material 40. In the ion nitriding, a hardness change is −2 [0.01 Hv/μm] in a region from the surface to the depth of about 70 μm in the 6-hour treatment but is −22.3 [0.01 Hv/μm] in a region deeper than the depth of about 70 μm, thus changing to a large extent, as shown in FIG. 8. A ratio between the changes is obtained as −22.3/−211.2. The ratio between the changes is a change ratio of the hardness changes before and after a point (hereinafter referred to as "point of deflection") at which the hardness change in the nitrogen diffusion layer 40D discontinuously changes with the denominator representing the hardness change from the surface to the point of deflection. In the neutral nitriding, a hardness change in a region from the surface to the depth of about 50 μm changes from [0.01 Hv/μm] to −14.6 [0.01 Hv/μm] in a 12-hour treatment, and a change ratio is obtained as −14.6/−5.1≈2.9.

The hardness change shows a large change (the ratio between the changes=11.2) at the depth of about 70 μm from the surface in the ion nitriding, and it is estimated that a gradient film would exist in the region from the surface to the depth of about 70 μm. When the material surface is subjected to external force from various directions in this state, it is assumed that the gradient film and a region deeper than the gradient film would differ in behavior. More specifically, it is suggested that failure due to stress concentration, fatigue or the like occur near a boundary between the gradient film and the region deeper than the gradient film. On the other hand, in the neutral nitriding, the hardness change transitions substantially continuously while the change ratio is about a quarter of the change ratio of the ion nitriding, with the result that the failure due to stress concentration, fatigue or the like is unlikely to occur.

The neutral nitriding has a characteristic that the hardness change continuously transitions also in the inside of the material (it is ideal that the change ratio is 1 and no deflection point exists) as well as a characteristic that a high surface hardness can be obtained. The neutral nitriding can thus impart high resistance to destruction due to stress concentration, fatigue or the like to the material. Generally speaking, it is desirable that the change ratio should range from 1 to 3 in the nitriding treatment.

This effect is considered to be achieved by the combination of the pretreatment step of applying the shot blasting of causing the elastic bodies 2 to collide against the surface of the metal material 40 for the purpose of mirror surface finish, and the neutral nitriding step. The above-described effect is considered to arise from the fact that the metal material 40 pretreated by the elastic bodies 2 for the mirror surface finish has a large number of dislocations caused by collision of the elastic bodies 2 in the inside thereof. The collision of the elastic bodies 2 causes a larger number of dislocations than caused in the normal metal material and increases the number of dislocations per unit of area (dislocation density) though the dislocations exist in normal metal materials.

In the conventional nitriding method, nitrogen atoms injected into the surface of the metal material 40 is saturated at some stage, and room for the nitrogen atoms is reduced, with the result that the nitrogen compound layer 40C is formed on the surface. In the metal material 40 having the dislocation density increased by the performance of the pretreatment using the elastic bodies 2, nitrogen atoms starting to enter the surface are sequentially diffused inside the metal material 40 along a slip line. As a result, the nitrogen atoms infiltrate the inside of the pretreated metal material 40 deeper and faster. Consequently, the above-described nitriding method can obtain a desired hardness in a shorter period of time as compared with the conventional nitriding method in which the pretreatment is not carried out. Further, the nitrogen atoms infiltrate deeper, so that the nitrogen diffusion layer 40D can be formed thicker, as compared with the conventional method.

Further, since the high dislocation density can convey the nitrogen atoms to the inside of the metal material 40 even in a lower treatment temperature environment as compared with the conventional method, the above-described nitriding method can reduce the treatment temperature. Further, regarding a stainless material which is difficult to treat in the conventional method, too, the infiltration of nitrogen atoms can be enhanced using the effect of introducing dislocations without damage to passive layers. With this, corrosion resistance and high surface hardness can be obtained. Still further, a high wear and abrasion resistance can be exerted even in a corrosive environment.

The above-described effects are considered to result also from that the metal material 40 pretreated using the elastic bodies 2 for the mirror surface finish has a ten-point average roughness Rz of not more than 50 nm (nanometer). Regarding the ten-point average roughness Rz, only a reference length is picked from a roughness curve in a direction of an average line. Heights of a highest peak to a fifth highest peak are measured in a direction of longitudinal magnification from the average line of the picked part. Depths of a lowest valley to a fifth lowest valley are measured in the direction of longitudinal magnification from the average line of the picked part. An average of absolute values of the heights of the peaks and an average of absolute values of the depths of the valleys are added together. The ten-point average roughness Rz represents the addition of the averages.

On the other hand, an untreated metal material 40 has a ten-point average roughness Rz which is normally expressed in μm (micrometers). The elastic bodies 2 are accelerated to cause collision against this metal material 40 at an angle of incidence, so that the surface of the metal material 40 has a mirror surface (with this, the dislocation density can be increased). Thus, the surface layer hardening method of the embodiment has characteristics differing to a large degree from those of the forming method in which projectiles of non-elastic bodies such as generally used iron balls or ceramic particles are accelerated to cause collision against the surface of the metal material 40 so that minute recesses are formed on the surface of the metal material 40.

Nitrogen atoms enter from the surface of the metal material 40 in the nitriding treatment. Accordingly, the number of nitrogen atoms becomes larger as the surface area is large. The nitrogen atoms incident on the surface of the metal material 40 are penetrated and accumulated in the inside of the metal material 40 mainly along the slip line as described above. When an incidence amount is larger than an infiltration amount, the nitrogen atoms are mainly accumulated near the surface, resulting in increase in the above-mentioned change ratio. This is undesirable. Further, increase in the nitrogen atom concentration results in generation of the nitrogen compound layer 40C. This is further undesirable.

The surface area of the metal material 40 can be reduced to one-several tenths to one-several hundredths by polishing the metal material 40 to a mirror finish of 50 nm (nanometer) or below in the ten-point average roughness Rz. As a result, the incidence with nitrogen atoms is limited, so that an incidence amount of the nitrogen atoms is balanced with an infiltration amount of the nitrogen atoms. As a result, it is considered that the nitrogen atoms are penetrated into the inside of the metal material 40 without stay and this contributes to reduction of the change ratio. More specifically, it is desirable that the metal material 40 should have a ten-point average roughness Rz of not more than 50 nm in the pretreatment by the elastic bodies 2 and it is further desirable that the metal material 40 should have a ten-point average roughness Rz of not more than 30 nm.

The invention should not be limited to the embodiment described above with reference to the drawings but the following embodiments are included in the technical scope of the invention:

(1) Although the cage made by netting the wire is used as the shielding member in the foregoing embodiment, the diameter of the cage and wire intervals may be changed appropriately.

(2) The treatment conditions of the plasma nitriding apparatus, the metal material, and the bias voltage applied to the cage may be changed appropriately.

(3) Although the tool steel SKD 61 is used as the metal material in the foregoing embodiment, another metal or alloy may be used, instead.

(4) Although the diamond abrasive grain having the grain diameter not more than 1 μm is used as the elastic abrasive grain in the foregoing embodiment, the grain diameter may be changed and silicon carbide, alumina, boron nitride or other abrasive grain may be used, instead.

(5) Although the resin is used as the base material of the elastic body in the foregoing embodiment, an elastic body such as rubber may be used, instead.

(6) The shot blasting conditions in the pretreatment step, an acceleration of the elastic body and the collision energy against the metal material may also be changed appropriately.

EXPLANATION OF REFERENCE SYMBOLS

2 . . . shot material (elastic body); 20 . . . treatment chamber; 30 . . . cage (shielding member); 40 sample (metal material, pretreated metal material); 40C . . . nitrogen compound layer; and 40D nitrogen diffusion layer.

The invention claimed is:

1. A surface layer hardening method comprising:

a pretreatment step by a shot blast treatment that causes elastic bodies to collide against a surface of a metal material; and a nitriding step of placing the metal material pretreated through the pretreatment step, within a treatment chamber, and forming a nitrogen diffusion layer in a surface layer of the pretreated metal material by nitrogen plasma generated by irradiating a nitrogen gas introduced into the treatment chamber with electron beams, and wherein in the nitriding step, nitrogen ions of the nitrogen plasma are blocked from entering the surface of the pretreated metal material while nitrogen atoms are allowed to enter the surface of the pretreated metal material, so that the nitrogen diffusion layer is formed in the surface layer.

2. The surface layer hardening method according to claim 1, wherein in the nitriding step, a shielding member is provided to surround the pretreated metal material and the nitrogen ions are blocked by the shielding member from entering the surface of the pretreated metal material.

* * * * *